US012604976B2

(12) United States Patent
Liu et al.

(10) Patent No.: US 12,604,976 B2
(45) Date of Patent: Apr. 21, 2026

(54) LIFTING DESK SUPPORT HAVING RAPID MOUNTING STRUCTURES, AND LIFTING DESK

(71) Applicant: CHANGZHOU KAIDI ELECTRICAL INC., Changzhou (CN)

(72) Inventors: Bin Liu, Jiangsu (CN); Jindong Xu, Jiangsu (CN); Huilong Wang, Jiangsu (CN)

(73) Assignee: CHANGZHOU KAIDI ELECTRICAL INC., Changzhou (CN)

( * ) Notice: Subject to any disclaimer, the term of this patent is extended or adjusted under 35 U.S.C. 154(b) by 50 days.

(21) Appl. No.: 18/708,274

(22) PCT Filed: Nov. 22, 2022

(86) PCT No.: PCT/CN2022/133580
§ 371 (c)(1),
(2) Date: May 8, 2024

(87) PCT Pub. No.: WO2023/083384
PCT Pub. Date: May 19, 2023

(65) Prior Publication Data

US 2025/0009121 A1 Jan. 9, 2025

(30) Foreign Application Priority Data

Nov. 10, 2021 (CN) ..... 202122739771.0

(51) Int. Cl.
*A47B 13/02* (2006.01)
*A47B 9/00* (2006.01)

(52) U.S. Cl.
CPC ..... *A47B 13/021* (2013.01); *A47B 9/00* (2013.01)

(58) Field of Classification Search
CPC ..... A47B 13/02; A47B 13/021; A47B 9/00; A47B 9/20; A47B 2200/0014; A47B 2200/0015
See application file for complete search history.

(56) References Cited

U.S. PATENT DOCUMENTS 11,382,414 B1 * 7/2022 Zhang ..... A47B 3/0818
11,730,261 B1 * 8/2023 Lin ..... A47B 13/08 108/59

(Continued)

FOREIGN PATENT DOCUMENTS

CN 201413634 Y 2/2010
CN 105831991 A 8/2016

(Continued)

OTHER PUBLICATIONS

International Search Report issued in corresponding International Patent Application No. PCT/CN2022/133580 dated Jan. 20, 2023.

*Primary Examiner* — Daniel J Rohrhoff

(57) ABSTRACT

A lifting desk support having rapid mounting structures and a lifting desk are provided. The lifting desk support includes a longitudinal beam and a cross beam assembly. The lifting desk support further includes a set of rapid mounting structures, which comprises a boss having a slope arranged on the longitudinal beam and a notch provided on the cross beam assembly. A locking block of the boss is embedded into the cross beam assembly through a first groove section of the notch, and a force along an axial direction of a cross beam of the cross beam assembly is applied to the longitudinal beam, such that the locking block enters a second groove section of the notch, and the locking and the assembly between the longitudinal beam and the cross beam assembly are achieved in a rapid and efficient manner with cost saved.

17 Claims, 6 Drawing Sheets

(56) References Cited

U.S. PATENT DOCUMENTS

| | | | | |
|---|---|---|---|---|
| 2003/0152421 | A1* | 8/2003 | Lu | F16B 9/058 403/188 |
| 2017/0135466 | A1* | 5/2017 | Randløv | A47B 9/04 |
| 2017/0251802 | A1* | 9/2017 | Lu | A47B 13/06 |
| 2019/0029413 | A1* | 1/2019 | Patton | A47B 3/06 |
| 2019/0125072 | A1* | 5/2019 | Tseng | A47B 9/20 |
| 2020/0260862 | A1* | 8/2020 | Knapp | A47B 21/03 |
| 2020/0359785 | A1* | 11/2020 | Lu | A47B 9/00 |
| 2021/0052064 | A1* | 2/2021 | Miller | F16B 12/52 |
| 2021/0100355 | A1* | 4/2021 | Jørgensen | A47B 21/02 |
| 2022/0304463 | A1* | 9/2022 | Zhu | A47B 13/06 |
| 2023/0270246 | A1* | 8/2023 | Lin | A47B 9/04 108/50.02 |

FOREIGN PATENT DOCUMENTS

| | | | |
|---|---|---|---|
| CN | 107205545 | A | 9/2017 |
| CN | 208000995 | U | 10/2018 |
| CN | 209450053 | U | 10/2019 |
| CN | 213849256 | U | 8/2021 |
| CN | 217390195 | U | 9/2022 |
| GB | 1169620 | | 11/1969 |
| JP | H08-187131 | A | 7/1996 |
| JP | 3196899 | U | 4/2015 |
| JP | 3209806 | U | 4/2017 |

* cited by examiner

LIFTING DESK SUPPORT HAVING RAPID MOUNTING STRUCTURES, AND LIFTING DESK

CROSS-REFERENCED APPLICATIONS

This application is a U.S. national phase entry under 35 U.S.C. § 371 from PCT International Application No. PCT/CN2022/133580 filed on Nov. 22, 2022, which is based upon and claims the benefit of priority from the prior Chinese Patent Application No. 202122739771.0 filed on Nov. 10, 2021. The entire contents of the above applications are incorporated herein by reference.

TECHNICAL FIELD

The present disclosure relates to the field of office furniture, in particular to a lifting desk support having rapid mounting structures and a lifting desk comprising the rapid mounting structures.

BACKGROUND

When the lifting desk is assembled, the support plays a key role in supporting the desk top and connecting the desk leg. Ordinary supports are generally composed of cross beams and longitudinal beams. During assembly, the support is connected with the desk legs by bolts. When customers assemble cross beams and longitudinal beams, they need to tighten the bolts to realize the assembly connection between the support and the desk legs. The process is relatively complicated and wastes a lot of time and manpower.

In order to save time and labor costs, the industry has gradually replaced the original screw assembly with welding, where cross beams and longitudinal beams are welded together. The locking and fastening of the desk surface support and the desk leg are achieved through a rapid mounting structure. This structure simplifies the assembly steps and saves time and manpower. However, since longitudinal beams and cross beams need to be welded vertically, the packaging size of the whole desk surface support is greatly increased, resulting in increases in the packaging cost, decreases in the number of desk surface supports packaged, and increases in the cost of a single product. In addition, the welding of longitudinal beams and cross beams makes the production process more complicated and easily causes local thermal deformation and environmental pollution, which is really undesirable.

In order to replace the welding process, rivets were used to connect cross beams and longitudinal beams, which put forward higher requirements for workers' operation steps and parts positioning. Rivet connection increases the cost and is prone to loose, which is also undesirable.

Therefore, a support structure with low cost, simple processing procedure, and fast and convenient connection between cross beams and longitudinal beams is required to meet the requirements of customers.

SUMMARY

To solve the problems existing in the above background art, an improved lifting desk support having rapid mounting structures and a lifting desk comprising rapid mounting structures are provided.

The technical scheme adopted by the present disclosure to solve the technical problems is as follows: a lifting desk support having rapid mounting structures, comprising a cross beam assembly, a longitudinal beam, a lifting desk leg, and a baseboard, with the cross beam assembly being mounted above the lifting desk leg, the baseboard being mounted below the lifting desk leg, and the longitudinal beam being mounted at a side end of the cross beam assembly. In some embodiments, the cross beam assembly and the longitudinal beam are provided with at least one set of rapid mounting structures, which comprise a boss arranged on the longitudinal beam and a notch on the cross beam assembly. In some embodiments, the boss is embedded into the notch to realize connection between the cross beam assembly and the longitudinal beam.

In some embodiments, the boss comprises a locking block and a connecting part, the notch comprises a first groove section and a second groove section which are communicated with each other. The first groove section is used for the locking block to pass through, and the second groove section is used to limit the locking block. In some embodiments, the first groove section and the second groove section are connected, and the locking block passes through the notch through the first groove section and enters the second groove section of the notch by applying a transverse force in an axial direction of the cross beam, to achieve the spacing.

In some embodiments, the boss is formed by bending and extending downwards from a plane of the longitudinal beam. In some embodiments, the locking block and the upper surface of the longitudinal beam have a slope. In some embodiments, when the locking block is mounted into the second groove section, the locking block and the upper surface of the longitudinal beam are arranged on opposite sides of the plane of the cross beam assembly respectively, and the locking block is gradually clamped against the tube wall of the cross beam assembly by applying a transverse force in the axial direction of the cross beam, thus realizing the locking between the longitudinal beam and the cross beam assembly.

In some embodiments, in the direction perpendicular to the axis of the cross beam assembly, a width of the first groove section is greater than that of the second groove section, a width of the locking block is less than or equal to that of the first groove section and greater than that of the second groove section, and the width of the locking block is greater than that of the connecting part.

In some embodiments, the notch may also include a third groove section. The second groove section and the third groove section are respectively arranged on both sides of the first groove section, and the second groove section and the third groove section are respectively communicated with the first groove section.

In some embodiments, the cross beam assembly may be of left and right split structures, which are slidably connected through connecting beams to realize axial expansion.

In some embodiments, the cross beam assembly comprises two cross beams arranged in parallel and fixed by several bridge pieces.

In some embodiments, at least one end of the connecting beam is provided with a spacing device, and the cross beam assembly is fixedly connected with a fastening device which can be used for fixing the connecting beam, such that the expansion range is limited through the cooperation between the spacing device and the fastening device.

In some embodiments, after the longitudinal beam is assembled with the cross beam assembly, fastening screws passes through a preset through-hole on the longitudinal beam and a preset through-hole on a bridge piece to connect the support with a desk top.

The technical scheme adopted by the present disclosure solves the defects in the background art and has the following advantages:

1. Rapid assembly of the longitudinal beam and the cross beam assembly improves assembly efficiency and saves labor costs;
2. The rapid assembly and disassembly of the longitudinal beam and cross beam assembly reduces the packaging volume and increases the number of desk surface supports to be packaged;
3. As the most preferred double notch-double boss pairing setting, it ensures that the desk surface is level and the user experience is upgraded;
4. The rapid mounting structure is simple and requires fewer types of parts;
5. The notch on the cross beam assembly and the boss on the longitudinal beam can be made by die stamping. The process is simple and reduces material costs and manual processing costs; and
6. The setting of expansion and the spacing device matches desk tops with different lengths, which improves the universality of the support.

Figure 1:
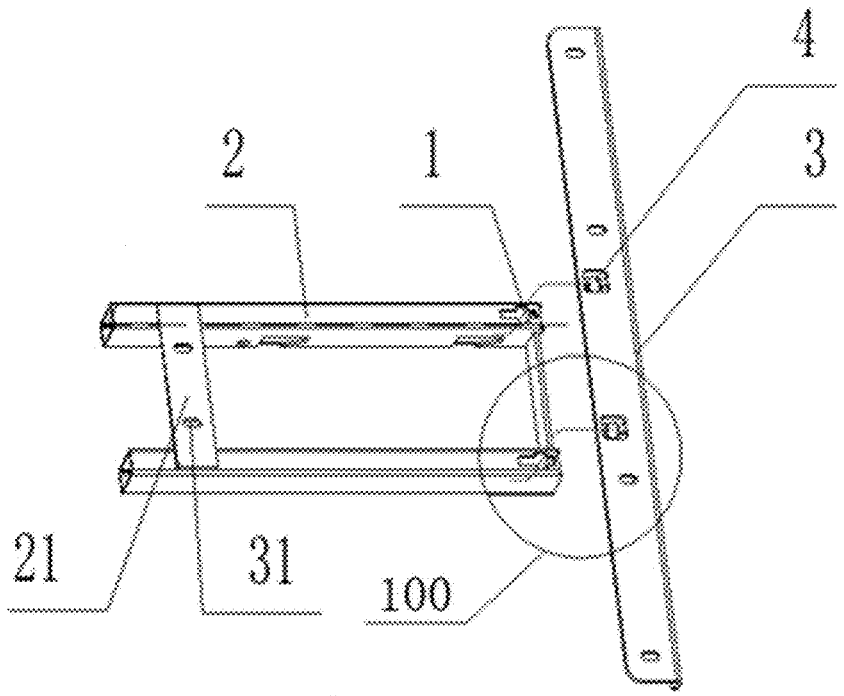
FIG. 1 is an axonometric view of a lifting desk support having rapid mounting structures according to some embodiments of the present disclosure.

Reference Numerals: 1—notch; 11—first groove section; 12—second groove section; 13—third groove section; 2—cross beam; 21—bridge piece; 3—longitudinal beam; 31—through-hole; 32—upper surface; 4—boss; 41—locking block; 42—connecting part; 5—connecting beam; 6—fastening device; 7—spacing device; 8—desk top; 9—fastening screw; 10—lifting desk leg; 14—baseboard.

DETAILED DESCRIPTION

The present disclosure will now be further described in detail with reference to the drawings and preferred embodiments. These drawings are simplified schematic diagrams for explaining only the basic structure of the present disclosure in a schematic manner, and therefore show only the construction related to the present disclosure.

Embodiment 1

As shown in FIGS. 1 through 10, a lifting desk support having rapid mounting structures comprises a cross beam assembly, longitudinal beam 3, lifting desk leg 10, and baseboard 14, with the cross beam assembly being mounted above lifting desk leg 10, baseboard 14 being mounted below lifting desk leg 10, and longitudinal beam 3 being mounted at a side end of the cross beam assembly. In some embodiments, the cross beam assembly is provided with bridge pieces 21.

As shown in FIG. 1, the cross beam assembly and longitudinal beam 3 are provided with two sets of rapid mounting structures, and each set of rapid mounting structures includes boss 4 on longitudinal beam 3 and notch 1 on the cross beam assembly.

Figure 4:
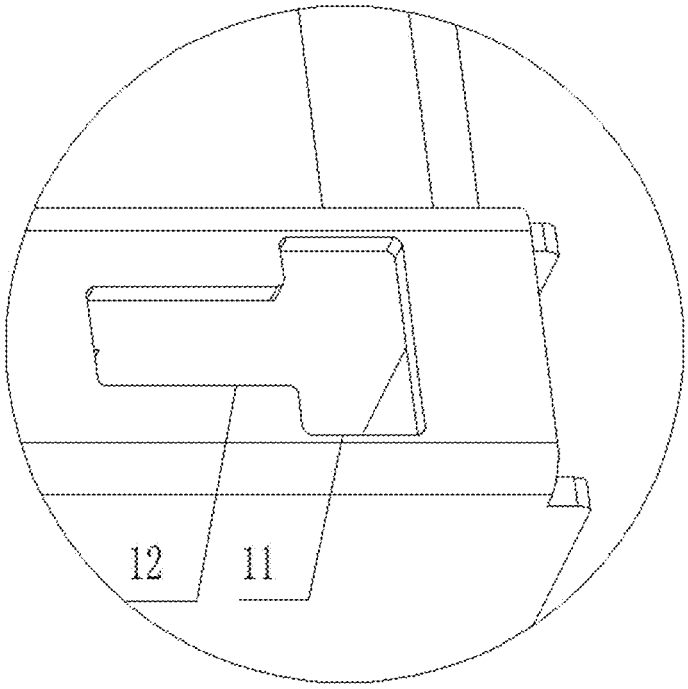
FIG. 4 is an alternative embodiment of FIG. 3.

As shown in FIG. 4, notch 1 comprises first groove section 11 and second groove section 12.

Figure 5:
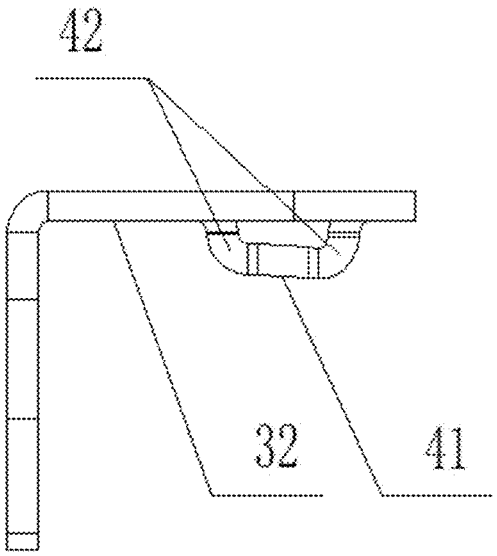
FIG. 5 is a left side view of the longitudinal beam in the rapid mounting structure according to some embodiments of the present disclosure.
Figure 6:
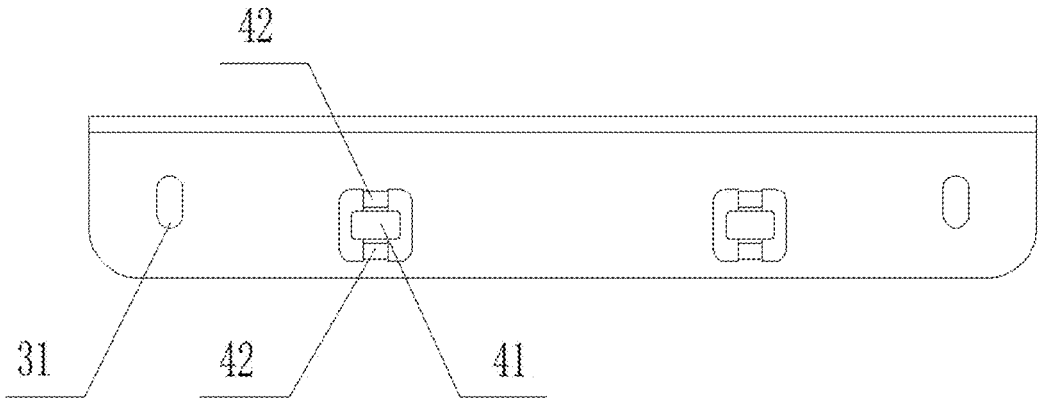
FIG. 6 is a top view of the longitudinal beam in the rapid mounting structure according to some embodiments of the present disclosure.
Figure 7:
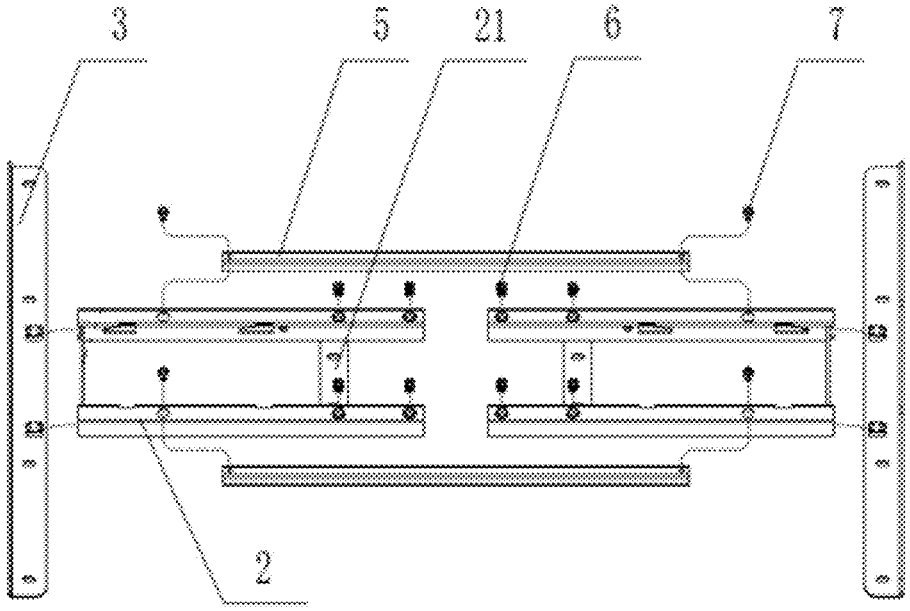
FIG. 7 is a partially exploded view of a lifting desk support having rapid mounting structures according to some embodiments of the present disclosure.
Figure 8:
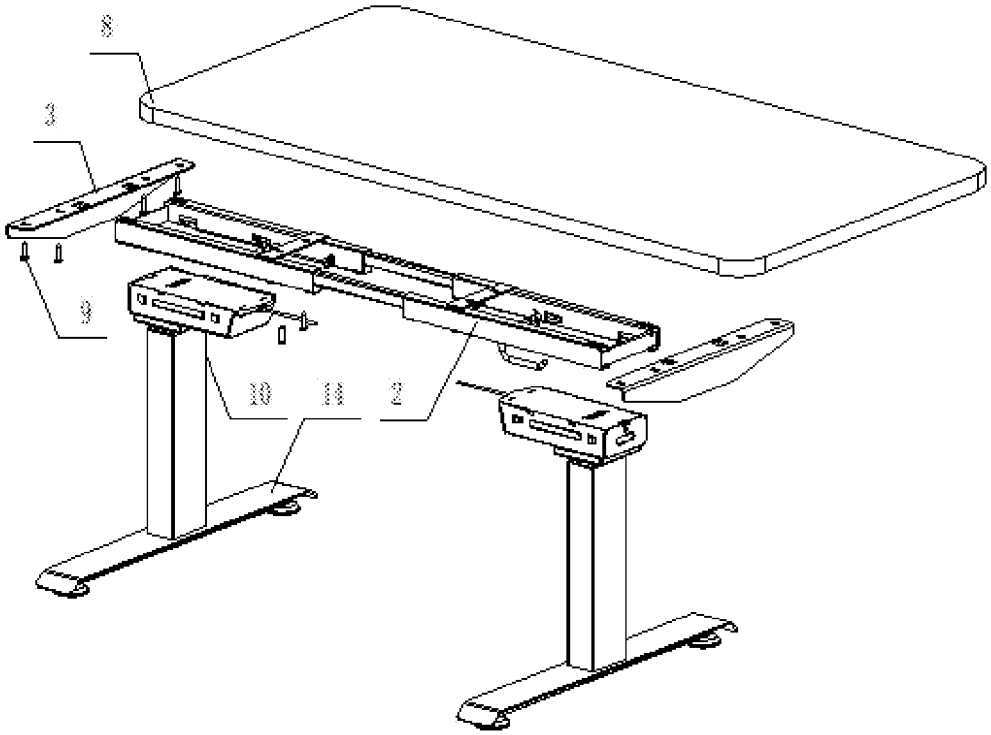
FIG. 8 is an exploded view of a lifting desk according to some embodiments of the present disclosure.
Figure 9:
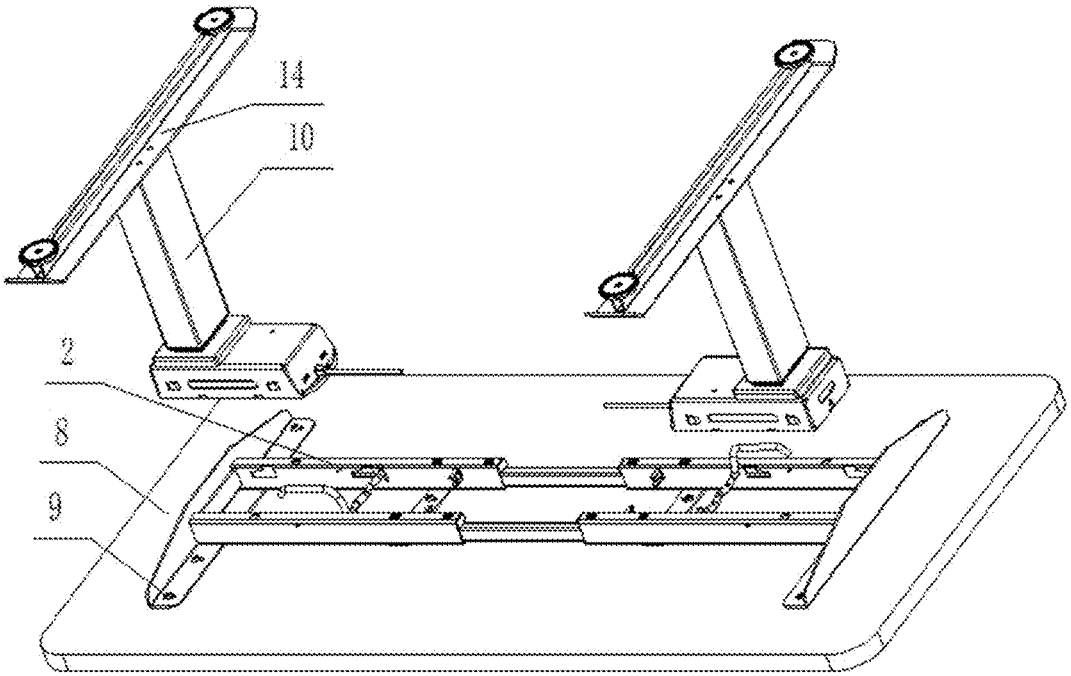
FIG. 9 is an assembly diagram of a lifting desk according to some embodiments of the present disclosure.
Figure 10:
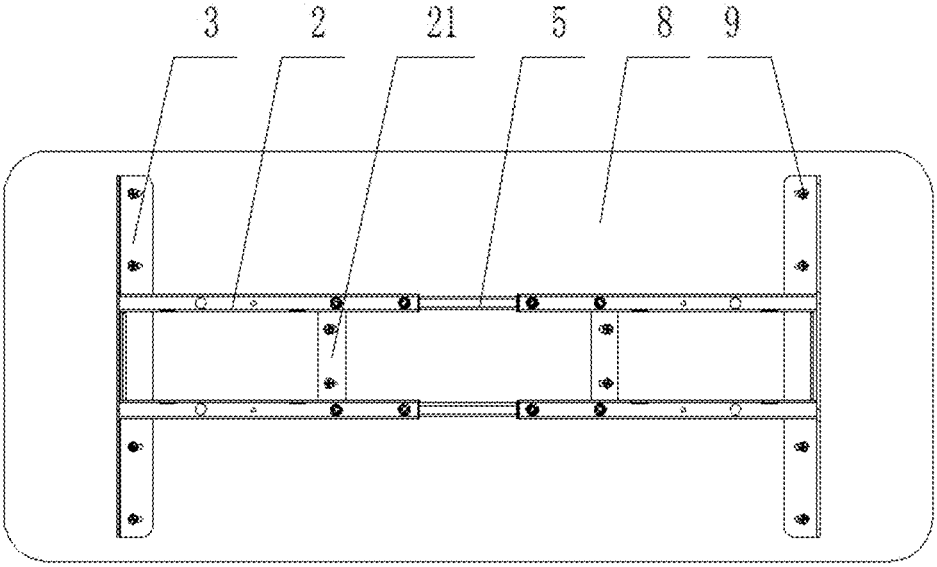
FIG. 10 is a mounting diagram of a lifting desk support according to some embodiments of the present disclosure.

As shown in FIGS. 5 and 6, boss 4 comprises locking block 41 and connecting parts 42. Boss 4 is formed by bending and extending downwards from a plane of longitudinal beam 3, and locking block 41 has a slope with upper surface 32 of longitudinal beam 3.

Figure 2:
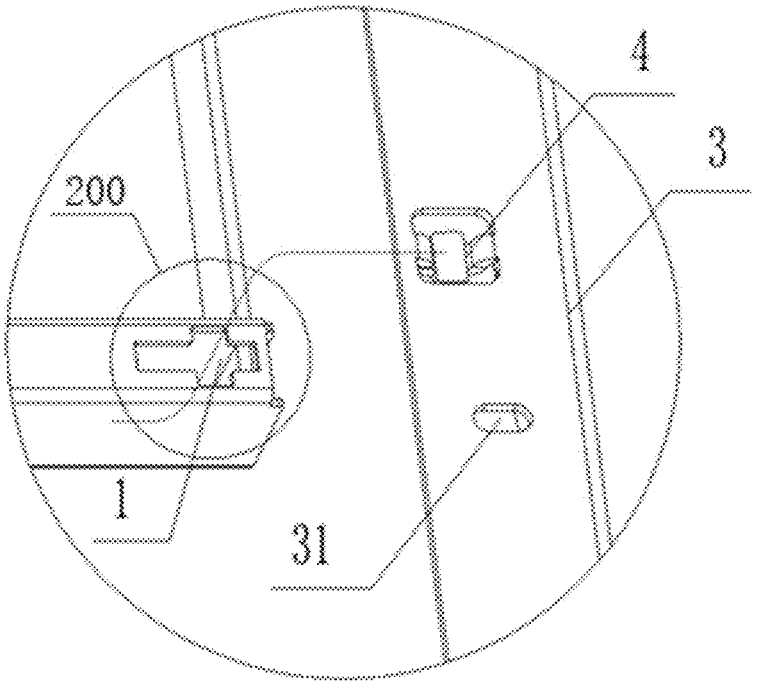
FIG. 2 is an enlarged view of Area 100 in FIG. 1.
Figure 3:
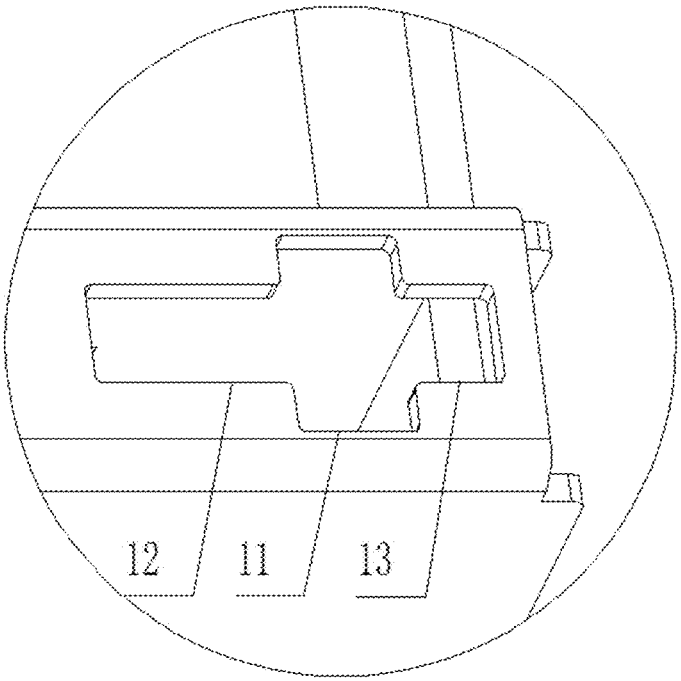
FIG. 3 is an enlarged view of Area 200 in FIG. 2.

As shown in FIGS. 1 and 2, in the direction perpendicular to the axis of the cross beam assembly, a width of first groove section 11 is greater than that of second groove section 12, a width of locking block 41 is less than or equal to that of first groove section 11 and greater than that of second groove section 12, and the width of locking block 41 is greater than that of connecting parts 42.

As shown in FIGS. 7 through 10, two cross beam assemblies are arranged on both ends of connecting beam 5, and connecting beam 5 is nested with the cross beam assemblies. Connecting beam 5 is provided with spacing devices 7. The cross beam assemblies are provided with fastening devices 6 for fixing connecting beam 5. Two longitudinal beams 3 are respectively arranged outside the cross beam assemblies.

When assembling, locking block 41 of boss 4 on longitudinal beam 3 passes through first groove section 11 of notch 1 on the cross beam assembly, and then a transverse force in the axial direction of cross beam 2 is applied to longitudinal beam 3. When locking block 41 enters second groove section 12 of notch 1, locking block 41 and upper surface 32 of longitudinal beam 3 are respectively arranged on both sides of a plane of the cross beam assembly. When the transverse force in the axial direction of cross beam 2 is continuously applied, locking block 41 will be gradually clamped against tube walls of the cross beam assembly. In this way, longitudinal beam 3 and the cross beam assembly are locked.

After longitudinal beam 3 and the cross beam assembly are mounted, lifting desk leg 10 and baseboard 14 are connected and fixed in turn, and then fastening screws 9 pass through preset through-hole 31 on longitudinal beam 3 and preset through-hole 31 on bridge piece 21 of the cross beam assembly to realize the connection between desk top 8 and the lifting desk support while ensuring that longitudinal beam 3 will not be separated from the cross beam assembly.

FIG. 4 shows another embodiment of notch 1 on the cross beam assembly, which comprises first groove section 11 and second groove section 12 connected to each other. Notch 1 shown in FIG. 3 comprises first groove section 11, second groove section 12, and third groove section 13, and second groove section 12 and third groove section 13 are arranged at two sides of first groove section 11 and communicate with first groove section 11, respectively.

Embodiment 2

Figure 11:
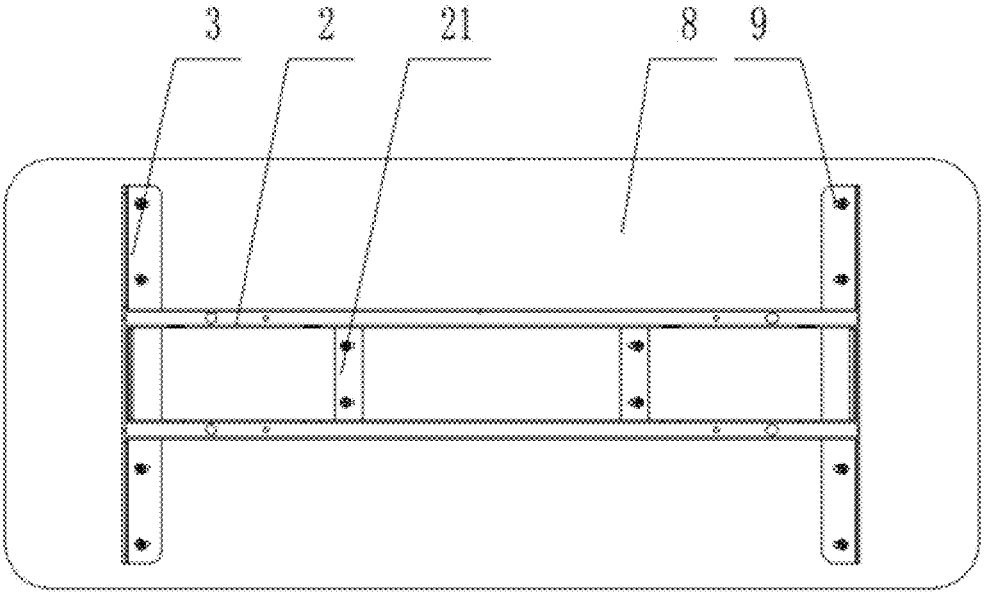
FIG. 11 is a mounting diagram of a lifting desk support according to some alternative embodiments of the present disclosure.

As shown in FIG. 11, the length of the lifting desk support in Embodiment 2 is not adjustable, and the rest structure of the lifting desk support is the same as that in Embodiment 1.

The design with the same effect as that of the present disclosure made by exchanging the boss provided on the longitudinal beam and the notch provided on the cross beam assembly is also within the scope of protection of this patent.

The above specification only describes the specific embodiments of the present disclosure, and various examples do not limit the substance of the present disclosure. Those skilled in the art can modify or deform the previous specific embodiments after reading the specification without departing from the essence and scope of the present disclosure.

The invention claimed is:

1. A lifting desk support having rapid mounting structures, comprising:

a cross beam assembly;

a longitudinal beam;

a lifting desk leg;

a baseboard; and at least one set of rapid mounting structures, wherein:

the cross beam assembly is mounted above the lifting desk leg;

the baseboard is mounted below the lifting desk leg;

the longitudinal beam is mounted at a side end of the cross beam assembly;

each set of rapid mounting structures of the at least one set of rapid mounting structures comprises a boss arranged on the longitudinal beam and a notch arranged on the cross beam assembly; and the boss is embedded into the notch to realize a connection between the cross beam assembly and the longitudinal beam;

wherein:

the boss comprises a locking block and a connecting part;

the notch comprises a first groove section for the locking block to pass through and a second groove section for limiting the locking block;

the first groove section is communicated with the second groove section; and the locking block passes through the notch through the first groove section by applying a transverse force along an axial direction of the cross beam assembly and enters the second groove section to realize locking and spacing.

2. The lifting desk support having rapid mounting structures according to claim 1, wherein:

the boss is formed by bending and extending downwards from a plane of the longitudinal beam;

the locking block has a slope with an upper surface of the longitudinal beam; and when the locking block is mounted into the second groove section, the locking block and the upper surface of the longitudinal beam are respectively arranged on two sides of a plane of the cross beam assembly, and the locking block is gradually clamped against a tube wall of the cross beam assembly by applying a transverse force along the axial direction of the cross beam assembly, such that the longitudinal beam and the cross beam assembly are locked.

3. The lifting desk support having rapid mounting structures according to claim 1, wherein, in the direction perpendicular to the axis of the cross beam, a width of the first groove section is greater than that of the second groove section, a width of the locking block is less than or equal to that of the first groove section and is greater than that of the second groove section, and the width of the locking block is greater than that of the connecting part.

4. The lifting desk support having rapid mounting structures according to claim 1, wherein:

the notch further comprises a third groove section;

the third groove section is arranged at a side of the first groove section opposite to the second groove section; and the third groove section is communicated with the first groove section.

5. The lifting desk support having rapid mounting structures according to claim 1, wherein:

the cross beam assembly comprises a left part and a right part separated to each other; and the left part and the right part are slidably connected through connecting beams to realize axial expansion.

6. The lifting desk support having rapid mounting structures according to claim 5, wherein:

at least one end of the connecting beam is provided with a spacing device;

the cross beam assembly is fixedly connected with a fastening device that is configured to fix the connecting beam; and an expansion range is limited through the cooperation between the spacing device and the fastening device.

7. The lifting desk support having rapid mounting structures according to claim 5, wherein, after the longitudinal beam is assembled with the cross beam assembly, fastening screws pass through a preset through-hole on the longitudinal beam and a preset through-hole on a bridge piece to connect the lifting desk support with a desk top.

8. The lifting desk support having rapid mounting structures according to claim 1, wherein the cross beam assembly comprises two cross beams arranged in parallel and fixed by a plurality of bridge pieces.

9. A lifting desk support having rapid mounting structures, comprising:

a cross beam assembly;

a longitudinal beam; and a set of rapid mounting structures, comprising a notch arranged on the cross beam assembly and a boss arranged on the longitudinal beam, wherein the boss comprises a locking block and connecting parts, the connecting parts fixedly bridging two opposite sides of the locking block to an upper surface of the longitudinal beam;

the notch comprises a first groove section for the locking block to pass through and a second groove section for locking and limiting the locking block, the first groove section being communicated with the second groove section; and the locking block is configured to pass through the first groove section and enter the second groove section to engage the boss and the notch, so that a connection between the cross beam assembly and the longitudinal beam is achieved.

10. The lifting desk support according to claim 9, wherein the locking block has a slope relative to the upper surface of the longitudinal beam.

11. The lifting desk support according to claim 9, wherein:

a width of the locking block is greater that a width of the connecting parts;

a width of the first groove section is greater than a width of the second groove section; and the width of the locking block is less than or equal to the width of the first groove section and is greater than the width of the second groove section.

12. The lifting desk support according to claim 9, wherein:

the notch further comprises a third groove section communicated with the first groove section; and the second groove section and the third groove section are arranged at opposite sides of the first groove section, respectively.

13. The lifting desk support according to claim 9, wherein:

the cross beam assembly comprises a first part and a second part;

each of the first part and the second part of the cross beam assembly comprises two cross beams arranged in parallel, the two cross beams being fixedly connected by a bridge piece; and the first part and the second part of the cross beam assembly are slidably connected through a connecting beam to realize axial expansion.

14. The lifting desk support according to claim 13, wherein:

a spacing device is arranged at an end of the connecting beam;

a fastening device is arranged on the cross beam assembly; and an expansion range of a slidable connection between the connecting beam and the cross beam assembly is limited through an engagement of the spacing device and the fastening device.

15. The lifting desk support according to claim 9, further comprises a lifting desk leg and a baseboard, wherein:

the lifting desk leg is mounted on top of the baseboard; and the cross beam assembly is mounted on top of the lifting desk leg.

16. A lifting desk, comprises a lifting desk support and a desk top, wherein:

the lifting desk support comprises:

a baseboard;

a lifting desk leg mounted on top of the baseboard;

a cross beam assembly mounted on top of the lifting desk leg;

a longitudinal beam assembled at a side of the cross beam assembly; and a set of rapid mounting structures, comprising a notch arranged on the cross beam assembly and a boss arranged on the longitudinal beam, wherein the boss comprises a locking block and connecting parts, the connecting parts fixedly bridging two opposite sides of the locking block to an upper surface of the longitudinal beam;

the notch comprises a first groove section for the locking block to pass through and a second groove section for locking and limiting the locking block, the first groove section being communicated with the second groove section; and the locking block is configured to pass through the first groove section and enter the second groove section to engage the boss and the notch, so that a connection between the cross beam assembly and the longitudinal beam is achieved.

17. The lifting desk according to claim 16, wherein:

the cross beam assembly comprises two cross beams arranged in parallel;

the two cross beams are fixedly connected by a bridge piece; and fastening screws pass through a preset through-hole on the longitudinal beam and a preset through-hole on the bridge piece to assemble the lifting desk support to the desk top.

* * * * *